United States Patent [19]

Werthessen

[11] Patent Number: 4,616,958

[45] Date of Patent: Oct. 14, 1986

[54] RETRACTION ASSEMBLIES FOR EXPANSIBLE MANDRELS

[75] Inventor: Nicholas H. Werthessen, Cranston, R.I.

[73] Assignee: Fru-Con Construction Corporation, Ballwin, Mo.

[21] Appl. No.: 670,915

[22] Filed: Nov. 13, 1984

[51] Int. Cl.[4] ..... E02B 17/00

[52] U.S. Cl. ..... 405/246; 405/232; 242/72; 74/110

[58] Field of Search ..... 405/232, 247, 246, 245, 405/274, 275, 276, 228; 279/2, 2 R; 242/72; 474/137, 138; 74/110

[56] References Cited

U.S. PATENT DOCUMENTS

| | | | |
|---|---|---|---|
| 3,086,783 | 4/1963 | Kelso | 242/72 |
| 3,264,834 | 8/1966 | Guild | 405/247 |
| 3,779,026 | 12/1973 | Guild | 61/53.72 |
| 3,802,207 | 4/1974 | Guild et al. | 61/53.72 |
| 4,026,117 | 5/1977 | Guild et al. | 61/53.72 |
| 4,074,539 | 2/1978 | Guild et al. | 405/246 |

*Primary Examiner*—Cornelius J. Husar

*Assistant Examiner*—Kristina I. Hall

[57] ABSTRACT

An expansible mandrel for use in driving or withdrawing tubular piles has lengthwise sections which are subjected to expanding forces in a plurality of zones spaced lengthwise of the interior of the mandrel to establish their pile-gripping relationship. The pile-entering relationship of the sections is re-established by a series of transversely spaced pairs of assemblies spaced lengthwise of the mandrel with each pair between adjacent zones. Each assembly includes, in the disclosed embodiment, two coil springs each of which is confined in a tube. The tubes are spaced apart lengthwise of and are secured to one mandrel section. The proximate ends of the tubes back the springs. A connection through both tubes with the remote ends of the springs has a flexible portion trained about a pair of guides attached to said one section and about a retraction cleat attached to the other mandrel section opposite the space between the two guides holds the springs tensioned to an extent ensuring the re-establishment of the pile-entering relationship of the mandrel sections when expanding forces thereon are relieved.

12 Claims, 8 Drawing Figures

RETRACTION ASSEMBLIES FOR EXPANSIBLE MANDRELS

BACKGROUND OF THE INVENTION

Expansible mandrels for use in driving and withdrawing tubular piles have lengthwise sections the upper ends of which are interconnected by a head. Means of one type or another are employed to force the sections apart, after the mandrel has been bottomed in a pile, into such contact with the interior of the pile that the pile is locked to the mandrel means of one type or another are also employed to effect the re-establishment of the pile-entering relationship of the sections once the pile has been driven to the wanted depth.

The most effective means for effecting the pile-gripping relationship of the sections utilizes a steel cable or cables reeved over groups of sheaves which bear alternatively on the interior of the two mandrel sections. The cable courses are so reeved relative to the sheaves of each group and so connected to the mandrel and to hydraulically operated means that when the latter is operated exert a straightening pull on the courses in the sheaves and accordingly the mandrel sections are moved apart with great force into their pile-gripping relationship. The present invention is illustrated with means of this type as such exert forces over substantially the full length of the mandrel ensuring that the mandrel and the pile are so securely coupled as to effect successful pile driving even with unfavorable soil conditions.

To effect the pile-entering relationship of the mandrel members, the members have been interconnected in a plurality of zones spaced lengthwise of the mandrel by resilient means either utilizing compression springs or leaf springs.

Resilient means of the compression spring type required that in each zone, the mandrel sections be interconnected at each side of the channel for the cable or cables by a rod extending through oppositely opening, aligned sockets with nuts threaded thereon by which the compression springs are held bottomed in their sockets. This construction, while satisfactory at the boot end of a mandrel and capable of retracting the mandrel sections if a sufficient number of such interconnections are employed, has the objectionable feature that bores were required through the sections which result in troublesome stress rises.

Resilient means of the leaf spring type, see U.S. Pat. No. 3,799,026, required that each leaf spring be located centrally of the mandrel sections with the ends of each spring connected to mounts spaced lengthwise of one section with the cable courses bridged by the mounts. The other mandrel section has a member underlying the central portion of each spring causing the spring to become tensioned as the mandrel sections are forced apart into their pile-gripping relationship.

While leaf springs have the advantage that the retracting forces of each is applied over a substantial length, they have the disadvantages that they are not adjustable and are relaxed except when expansion forces are exerted.

Another system of re-establishing the pile-entering relationship of the sections was to employ a cable-sheave arrangement such with a pull on the retraction cable as by hydraulically operated means, the mandrel sections were positively forced together. Such a system while effective to ensure the freeing of the mandrel sections from the driven pile added substantially to the cost of the mandrel and increased assembly and servicing problems.

THE PRESENT INVENTION

The general objective of the present invention is to provide means for re-establishing the pile-entering relationship of the mandrel sections that are not only free of the objectionable features of previously employed structures but are capable of better meeting construction, assembly and servicing requirements while ensuring that adequate retraction forces are applied in a plurality of zones of substantial lengths.

In accordance with the invention, this objective is attained with resilient means including a series of assemblies spaced lengthwise of the mandrel between adjacent zones where groups of sheaves are located. In practice the series consists of pairs of assemblies, one assembly mounted on each side of the channels for the cable courses but so dimensioned as not to interfere therewith.

Each assembly consists of a flexible member trained about a pair of guides spaced apart lengthwise of one mandrel section and secured thereto and about a retraction cleat located opposite the space between the two guides and secured to the other mandrel section. The flexible member has end portions extending lengthwise of said one section beyond the guides with one end portion connected to a tensioned coil spring and the other end connected to an anchor of a second tensioned coil spring. The coil spring or springs extend lengthwise of said one mandrel section with the end or ends proximate to the guides backed by means fixed thereto with each spring having an end portion of the flexible member connected to its remote end. In practice, the flexible member is a chain and the guides are chain rollers.

Another objective of the invention is to provide that the retraction force of each assembly is exerted in an area of substantial length.

This objective is attained with each spring of the assemblies a free fit within a guide tube welded to said one section lengthwise thereof with a stud or rod extending freely through the end of the guide tube which backs the spring. The stud, which is an end portion of the flexible member, extends axially through the spring and a nut threaded on the end of the stud within the tube provides means for adjusting spring tension. The guide associated with each spring and its tube is so located that it is not engaged by the stud even when the mandrel sections are forced apart to the maximum extent but the end of the flexible member connected thereto is held by the guide in axial alignment with the stud. The guides are so positioned that the courses of the flexible portions between them and the cleat are parallel. These courses are interconnected by a stop bar which, on disassembly of the mandre seats against said one mandrel section and provides a loop dimensioned to fit over a cleat when the mandrel is reassembled.

Other objectives of the invention and the manner of their attainment will be apparent from the following description of a preferred embodiment and the appended claims.

BRIEF DESCRIPTION OF THE DRAWINGS

The accompanying drawings illustrate a preferred embodiment of the invention of which—

THE PREFERRED EMBODIMENT OF THE INVENTION

Figure 1:
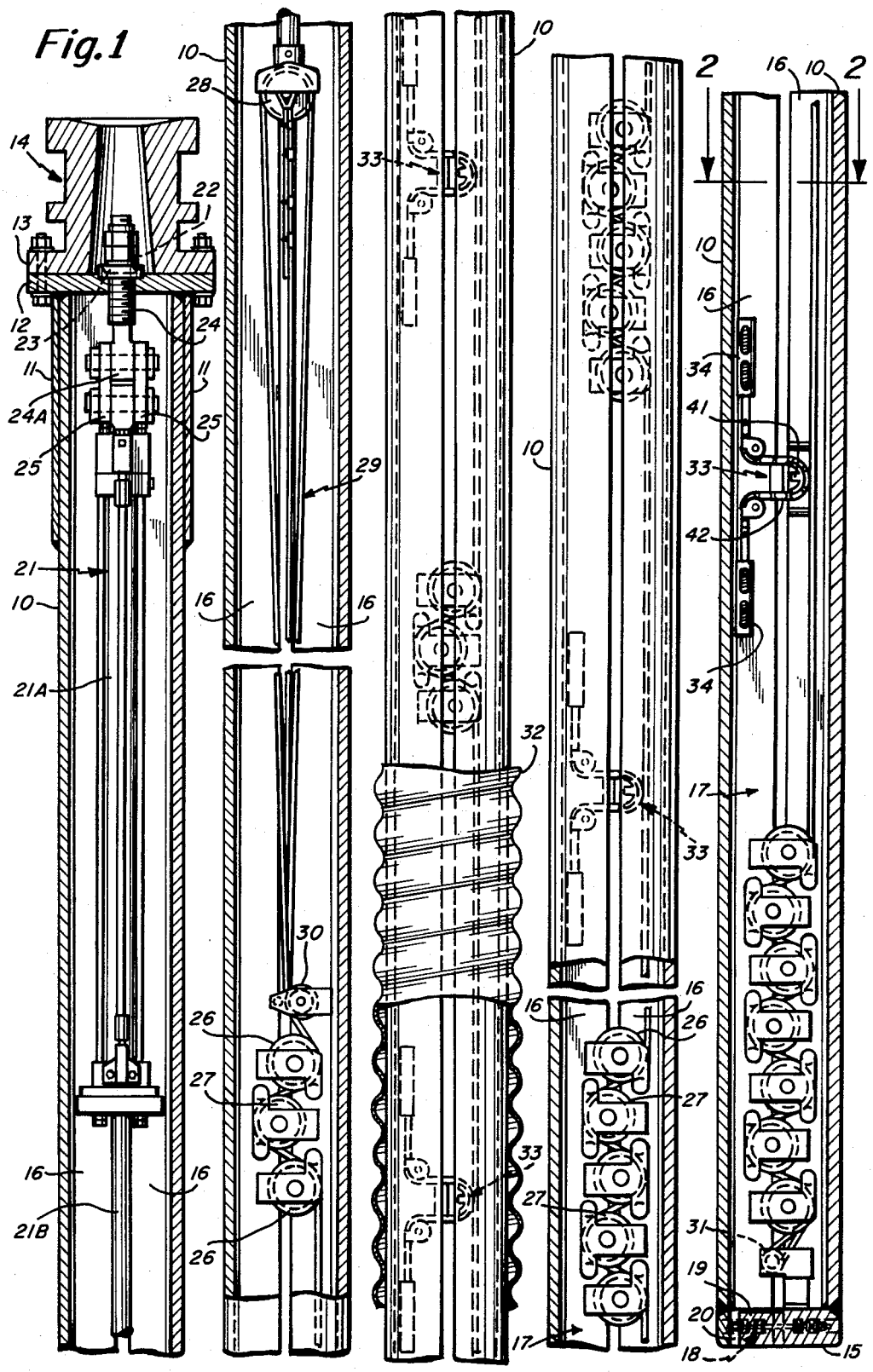
FIG. 1 is a somewhat schematic, longitudinal section of a mandrel in accordance with the invention with the mandrel sections in their pile-grippig relationship.
Figure 2:
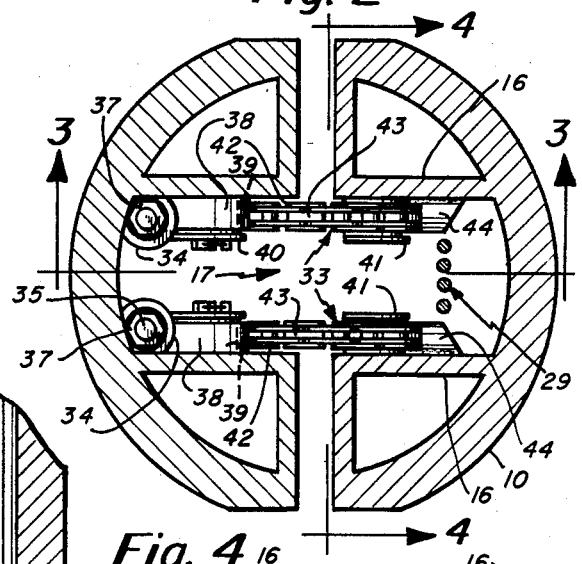
FIG. 2 is a section taken approximately along the indicated line 2—2 of FIG. 1.

The expansible mandrel is of the type having a pair of arcuate sections 10 of substantial length and of an arcuate extent close to but less than 180°. The sections have external reinforcements 11 at their upper ends and are joined by a circular head section or end plate 12 bolted to the flange 13 of a drive head, generally indicated at 14 with the sections biased towards each other a short distance below the head 14.

Each section 10 has a boot or foot portion 15 closing its bottom end, internal reinforcements 16oof right angular section welded thereto and establishing a central lengthwise channel, generally indicated at 17. The boot sections 15 are yieldably held abutting by retraction means, generally indicated at 18 and which may be of the compression spring type. One boot section has a transverse central key 19 which is s1idably entrant of a keyway 20 with which the other boot portion is provided.

The mandrel, as thus far described is of the type shown and described in the above referred to patents and the means for effecting the pile-gripping relationship of its sections 10 is, for convenience, shown as operated by a hydraulic, piston-cylinder unit, generally indicated at 21. The end plate 12 joins the sections 10 and has a central bore provided with a concave seat 22 for a spherical washer 23 through which extends a bolt 24 having a head 24A to which the upper ends of a pair of links 25 are pivotally connected with their lower ends pivotally connected to the upper end of the cylinder 21A of the piston-cylinder unit.

A plurality of sheaves 26 and 27 are employed in groups with the sheaves 26 connected to one section 10 and the sheaves 27 connected to the other section and alternating with the sheaves 26 in the groups. The number of sheaves in each group is shown as decreasing from a maximum adjacent the boot end of the mandrel.

The free end of the piston rod 21B of the unit 21 supports a pulley 28 about the shaft of which the extremities of the end courses of a cable 29 are caught by closed loops. The intermediate courses are trained about the pulley 28 and the several courses of the cable are trained over a centralizing sheave 30, reeved about the sheaves 26 and 27 of each group and trained about the reversing sheave 31 at the boot end of the mandrel. The reeving is such that when the hydraulic system, not shown, is actuated to retract the piston of the unit 21, a straightening pull is exerted on the cable courses forcing the sheaves 26 and 27 and the sections 10 apart into their relationship in which they grip the pile 32 in which the mandrel has been bottomed while its sections 10 are in their pile-entering relationship. Only a fragment of the pile 32 is shown in the drawings.

The means by which the mandrel sections are forcibly returned to their pile-entering relationship when the hydraulic pressure in the cylinder of the unit 21 is relieved consists of a plurality of assemblies generally indicated at 33 and spaced lengthwise of the mandrel between the groups of sheaves. In practice there are two such assemblies between the zones occupied by the sheave groups.

Each assembly 33 is shown as having a pair of guide tubes 34 extending lengthwise of the bottom of the channel of one section 10 and welded to the appropriate one of its reinforcements and the channel bottom. The tubes 34 are open at their opposite ends and are spaced a substantial distance apart. Studs 35, one for each tube 34 are slidably entrant of the proximate tube ends. Each stud 35 extends through the coils of a spring 36 confined within a tube with the spring held by an adjustable tensioning nut 37 against the appropriate one of the proximate tube ends appropriately tensioned. Each assembly 33 also has a guide in the form of a roller 38 confined on a shaft 39 by a detachable guide plate 40 with each shaft 39 supported by the appropriate channel wall.

Each assembly also includes an arcuate retraction cleat 41 fixed on the appropriate channel wall of the other mandrel section 10 opposite the space between the rollers 38.

A chain 42 is trained about the cleat 41, the guide rollers 38 and has its ends connected to the studs 35 thereby to establish a flexible connection between the two springs 36 so that the tension of the springs yieldably opposes the expanding forces and is effective to force the return of the sections 10 into their pile-entering relationship with their force exerted centrally of the sections and through substantial lengths thereof. It will also be noted the rollers 38 are so located that courses of each chain 42 between the guide rollers 38 and the cleat 41 of each assembly are parallel and normal to the mandrel axis and interconnected by a disassembly stop bar 43. The chain rollers 38 are so spaced and positioned relative to the tubes 34 that they are not engaged by the studs 35 even when the mandrel has been expanded to the maximum extent and that the portion of the chain 42 between each chain roller and the stud to which it is connected is in axial alignment with that stud.

Figure 3:
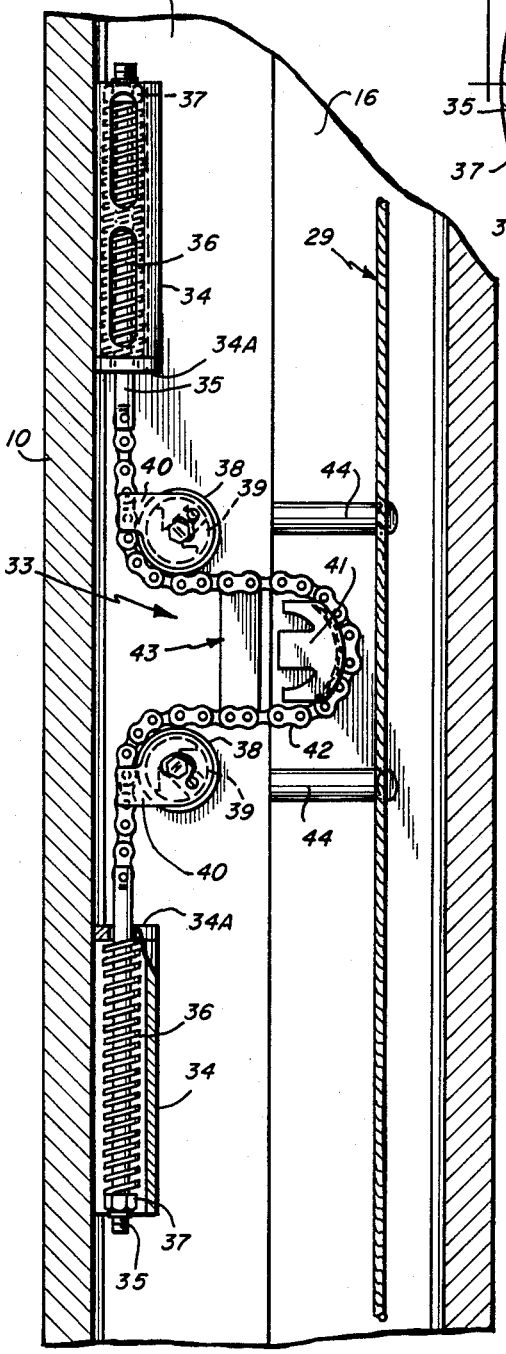
FIG. 3 is a section taken substantially along the indicated line 3—3 of FIG. 2 but with the pile omitted and the sections in their pile-entering relationship.
Figure 4:
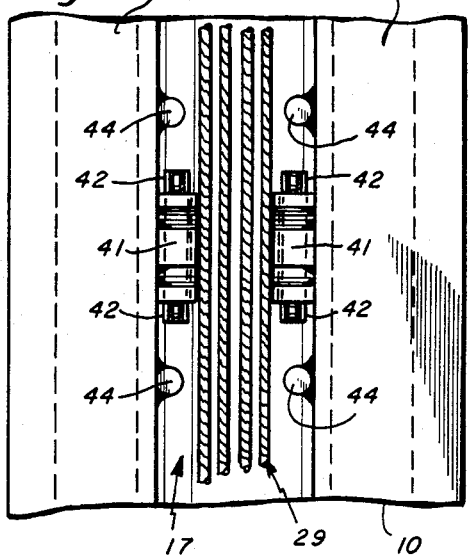
FIG. 4 is a section taken along the indicated line 4—4 of FIG. 2 but with the pile omitted.
Figure 5:
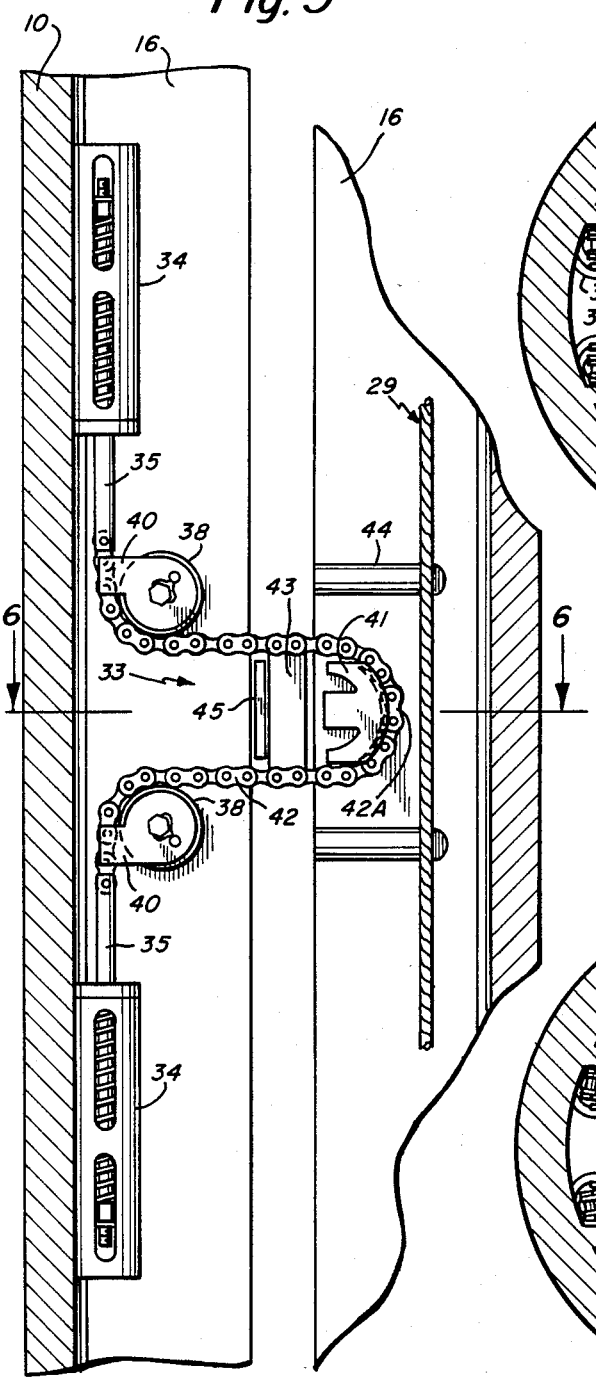
FIG. 5 is a view, similar to FIG. 3, but with the mandrel sections spaced apart to so expose the stop bars of the retraction assemblies that a bar can be inserted under them to prevent their retraction.

While the assemblies 33 are spaced from the cable courses and do not obstruct the channels, see FIGS. 3 and 4, guards 44 are provided on each side of each cleat 41 to prevent contact of the cable course with the chains 42 when the cable courses are relaxed.

In use the springs 36 are so compressed as to yieldably hold the pile sections 10 in their pile-entering relationship and they are further so compressed as the sections are forced apart into tight gripping contact with the pile 32 that once the expanding force of the sheaves 26 and 27 is released, the sections 10 are forcibly disengaged from the pile and returned to their relationship enabling the mandrel to be withdrawn therefrom.

The role of the stop bars 43 is that of enabling the disassembly and reassembly of the mandrels to be readily effected, see FIGS. 5, 6, 7, and 8.

Figure 6:
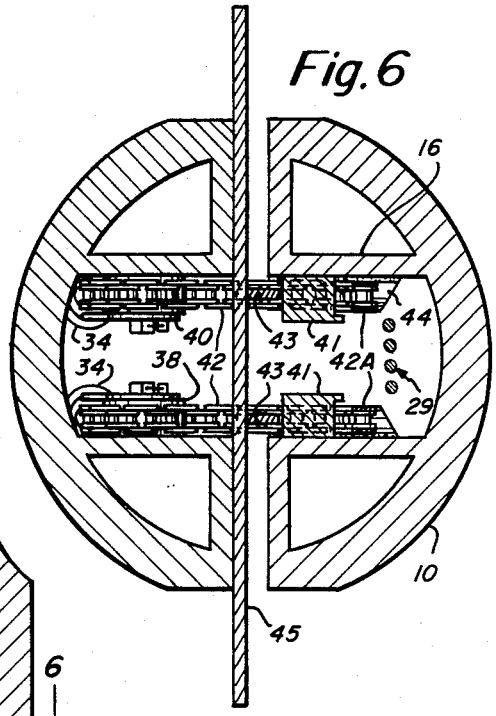
FIG. 6 is a section taken approximately along the indicated line 6—6 of FIG. 5.

When a mandrel is to be disassembled, the sections 10 are forced apart to the maximum extent with the stop bars 43 so fully exposed between the mandrel sections that, see FIG. 6, a bar 45, long enough to extend entirely across the mandrel section to which the springs 36 are anchored, can be inserted between that section and the stop bars 43 of the retraction assemblies 33 in that zone. The stop bars are thus held from being retracted by the springs 36. When the mandrel sections are then brought closer together to an extent so freeing the portions 42A of the chains 42 that were trained about a cleat 41 from engagement therewith that each may be dislodged therefrom by holding at one side of the mandrel a rod 46 against the adjacent stop bar 43 and striking it with a hammer. After this operation has been repeated on the retraction assemblies in each zone and the retraction means 18 interconnecting the foot portions 15 released, the sections are freed to be spread apart to the wanted extent.

Figure 7:
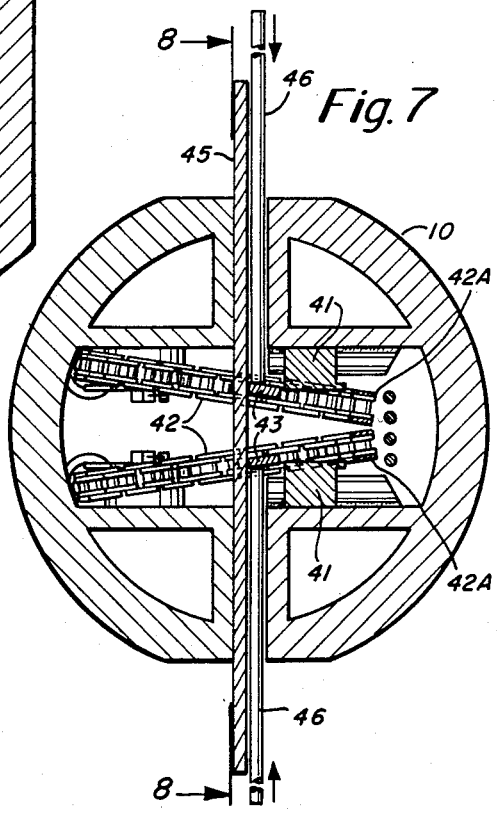
FIG. 7 is a like view illustrating the dislodgment of the chains from the cleats.
Figure 8:
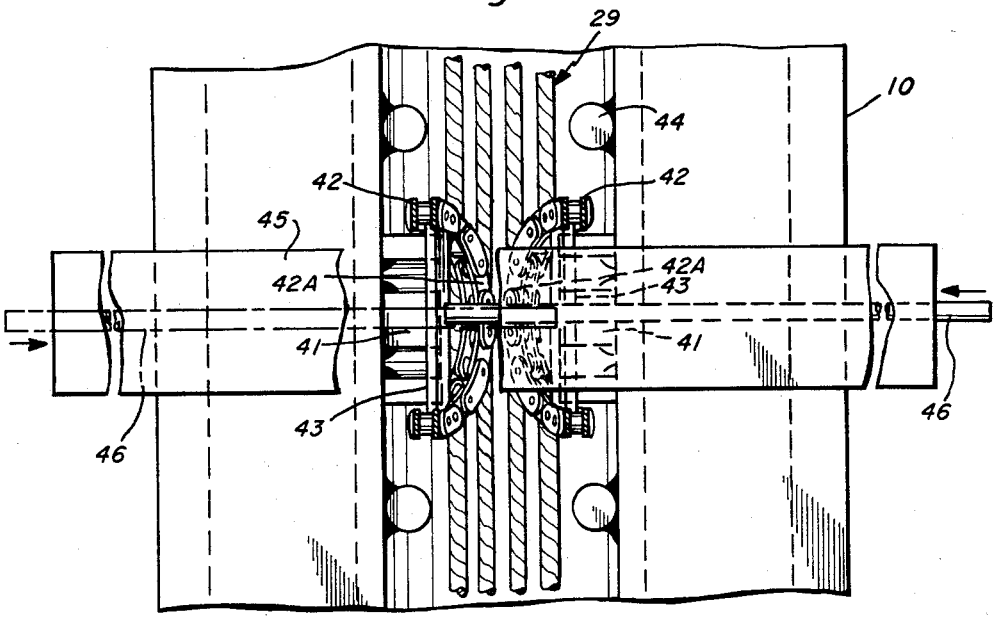
FIG. 8 is a section taken approximately along the indicated line 8—8 of FIG. 7.

When a mandrel is to be reassembled, the mandrel sections are placed in their relationship shown in FIG. 7 and by inserting a rod 46 against a stop bar 43 from the opposite side of the mandrel, the stop bar and the associated chain portion 42A may be driven back so that the portion 42A has its original relation to the cleat 41 about which it was trained. By reversing the procedure employed for disassembly purposes for the retraction assemblies in each zone, the mandrel sections are again operatively connected.

I claim:

1. An expansible mandrel for use in driving or withdrawing tubular piles and the like, said mandrel comprising two sections, head structure joining the upper ends of said sections, said sections shaped and dimensioned for movement towards and away from each other between pile-entering and pile-gripping relationships, fluid pressure operated means within said mandrel operable to apply expanding force against said sections in a plurality of zones spaced lengthwise of the mandrel thereby to effect said pile-gripping relationship, and resilient means yieldably opposing expanding forces and operable to reestablish said pile-entering relationship when said fluid pressure operated means is not in service, said resilient means including a series of assemblies spaced lengthwise of said mandrel, each assembly between an adjacent pair of zones, each assembly including a coil spring extending lengthwise of one section, means connected to said one section and backing one end of said spring, anchoring means spaced from said backing means lengthwise of said one section and connected to said one section, a pair of guides between said backing and anchoring means, said guides connected to said one section and spaced lengthwise from each other, a retraction cleat connected to said other mandrel section opposite the space between said guides and a connection between the other end of said spring and said anchoring means and including a flexible portion in trained engagement with said guides and said cleat and holding said spring compressed.

2. The mandrel of claim 1 in which the anchoring means is a second spring and second backing anchoring means therefor.

3. The expansible mandrel of claim 2 in which each backing means is a guide tube welded to the interior of said one mandrel section to extend lengthwise thereof and slidably confines the spring, and the connecting means includes a stud for each backing means with one end portion thereof extending slidably through said tube end and through the coils of the spring, a nut is threaded on said end portion operable to engage the other spring end and hold the spring under wanted tension, and the other end portion of each stud protrudes from the tube with one end of the flexible portion connected thereto.

4. The expansible mandrel of claim 2 in which the guides of each assembly are spaced apart a distance such that the courses of the flexible portion between the guides and the cleat are parallel.

5. The expansible mandrel of claim 4 in which each assembly includes a stop bar interconnecting the courses of the flexible portion between the guides and the retraction cleat, said bar spaced from the cleat and establishing a loop portion in the member dimensioned to fit over the cleat and the springs are so tensioned and dimensioned as to enable the mandrel sections to be spaced apart a distance such that the stop bar is fully exposed between the sections.

6. The expansible mandrel of claim 5 and a bar dimensioned to be inserted between the stop bar and the mandrel section to which the springs are anchored thus to hold the stop bar from being retracted whereby, when the mandrel sections are then brought closer together, the stop bar can be engaged from one side of the mandrel and forced to dislodge the loop from the cleat and when thus employed from the other side of the mandrel used to force the loop over the cleat to be in trained engagement therewith when the inserted bar is removed.

7. The expansible mandrel of claim 3 in which the guide of each unit is so positioned relative to the other end portion of the stud so as not be be engaged thereby when the mandrel is expanded to the maximum extent when inserted in the pile, and so that the end of the flexible portion connected to the stud is axially aligned therewith.

8. The expansible portion of claim 4 in which the flexible portion is a chain and the guides include chain rollers and chain retainers.

9. The expansible mandrel of claim 2 in which each mandrel section has lengthwise reinforcements which establish the side walls of a lengthwise, central channel, the means for applying expanding forces to the sections is of a type having cables in trained engagement with groups of sheaves, one group in each zone, and the assemblies are arranged in transversely spaced pairs with each assenbly secured to the appropriate channel wall with the cleat thereof located close to the mouth of the channel of said other mandrel section and fixed on the aligned channel wall thereof.

10. The expansible mandrel of claim 9 in which a cable guard is located on each side of each cleat.

11. The expansible mandrel of claim 9 in which the guides of each assembly of each pair are spaced apart a distance such that the courses of the flexible portion between the guides and the cleat are parallel and each assembly includes a stop bar interconnecting said courses, said bar spaced from the cleat and establishing a loop portion of the member dimensioned to fit over the cleat and the springs are so tensioned and dimensioned as to enable the mandrel sections to be spaced apart a distance such that the stop bars of each pair are fully exposed between the sections.

12. The expansible mandrel of claim 11 and a bar dimensioned to be inserted between the stop bars and the mandrel section to which the springs are anchored thus to hold the stop bars from being retracted whereby when the mandrel sections are then brought closer together, each stop bar can be engaged from one side of the mandrel and forced to dislodge the cleat and when thus employed from the other side of the mandrel used to force the loop over the cleat to be in trained engagement therewith when the inserted bar is removed.

* * * * *